US005771904A

United States Patent [19]

Lange et al.

[11] Patent Number: 5,771,904

[45] Date of Patent: Jun. 30, 1998

[54] BRISTLES FOR A HAIRBRUSH

[75] Inventors: Peter Lange, Eppstein; Peter Ruppert, Karben; Cornelia Seifert, Bad Soden, all of Germany

[73] Assignee: Braun Aktienfesellschaft, Frankfurt, Germany

[21] Appl. No.: 612,594

[22] Filed: Mar. 8, 1996

[30] Foreign Application Priority Data

Dec. 8, 1995 [DE] Germany ..... 295 20 134 U

[51] Int. Cl.[6] ..... A45D 24/00

[52] U.S. Cl. ..... 132/159; 132/144; 132/152; 132/901; 132/161

[58] Field of Search ..... 132/161, 159, 132/160, 152, 153, 154, 158, 125; D28/29, 21, 30, 31, 34

[56] References Cited

U.S. PATENT DOCUMENTS

| | | | |
|---|---|---|---|
| D. 199,657 | 11/1964 | Vallis | D28/21 |
| D. 269,298 | 6/1983 | Oberheim | D28/35 |
| D. 282,875 | 3/1986 | Harvey | D28/31 |
| D. 282,876 | 3/1986 | Harvey | D28/31 |
| D. 313,871 | 1/1991 | Oberheim | D28/35 |
| D. 330,781 | 11/1992 | Balster et al. | D28/30 |
| 1,510,217 | 9/1924 | Goldberg | 132/125 |
| 1,670,161 | 5/1928 | Meyer | 132/160 |
| 1,893,864 | 1/1933 | Kocher | 132/158 |
| 1,942,753 | 1/1934 | Griffin | 132/159 |
| 2,027,121 | 1/1936 | Ross | 132/159 |
| 2,484,133 | 10/1949 | Von Duyke | 132/125 |
| 4,345,608 | 8/1982 | Cavaioli et al. | 132/160 |
| 4,461,312 | 7/1984 | Gueret | 132/88.7 |
| 4,561,456 | 12/1985 | Gueret | 132/88.7 |
| 5,297,565 | 3/1994 | Charitar et al. | 132/152 |

FOREIGN PATENT DOCUMENTS

| | | | |
|---|---|---|---|
| 0 635 222 A2 | 1/1995 | European Pat. Off. | A45D 24/04 |
| 965939 | 4/1948 | France | 132/158 |
| 83510 | 10/1895 | Germany | A45D 20/48 |
| 32 18 800 C2 | 12/1982 | Germany | A45D 40/26 |
| 36 15 593 | 11/1987 | Germany | A45D 34/04 |
| 43 12 017 A1 | 4/1993 | Germany | A46B 7/00 |
| 42 36 036 A1 | 4/1994 | Germany | A45D 20/12 |
| 44 05 763 A1 | 8/1995 | Germany | A45D 20/48 |

*Primary Examiner*—Gene Mancene
*Assistant Examiner*—Eduardo C. Robert
*Attorney, Agent, or Firm*—Edward S. Podszus

[57] ABSTRACT

The invention is directed to bristles for a hairbrush, in particular for employment in an appliance for personal use as, for example, a curling iron, a curling brush, a hair dryer or the like, including a bristle base (3) and a bristle head (5). In this arrangement, the bristle base (3) is adapted to be fastened to a bristle supporting structure (7). The bristles (1) include at least two sections (9, 11) with cross-sectional areas of different sizes. A section with an increased cross-sectional area (11) adjoins the bristle base (3) having a reduced cross-sectional area, so that the bristle (1) is provided with a neck portion (17) between the bristle supporting structure (7) and the section with the increased cross-sectional area (11).

25 Claims, 2 Drawing Sheets

BRISTLES FOR A HAIRBRUSH

BACKGROUND OF THE INVENTION

This invention relates to bristles for a hairbrush, in particular for employment in an appliance for personal use as, for example, a curling iron, a curling brush, a hair dryer or the like, including a bristle base and a bristle head. In this arrangement, the bristle base is arranged on a bristle supporting structure, and the bristles include at least two sections with cross-sectional areas of different sizes.

PRIOR ART

The present invention is based on a subject-matter as known from DE 44 05 763 A1. This specification describes an appliance for treating hair which is composed of a handle portion and a heatable business portion. The business portion possesses a bristle supporting structure composed of two half shells. Extending from the first half shell are bristles, while the second half shell is provided with ribs. The radius of the cross-section of the bristled half shell is smaller than the radius of the cross-section of the ribbed half shell. These different radii enable a user both to style waves in long or mid-long hair and to deal with short hair in the area close to the scalp. The bristles of a row of bristles are arranged in a bristle strip inserted into the bristle supporting structure essentially parallel to the longitudinal axis of the bristle supporting structure.

In brushes of the aforementioned type it has shown that the process of catching the hair to be treated by the bristles is worthy of improvement. Further it may be desirable that the hot areas located between the individual bristle strips on the heatable business portion. be less accessible to the user's touch.

From the prior art (EP 0 635 222 A2) it is further known to provide a comb or a hairbrush with a plurality of teeth in parallel arrangement. The teeth are configured as essentially elliptically formed loops, with the ends of the loops being each connected with a common left and right spine member. This invention had as object to provide a comb or a brush that prevents the scalp from being hurt, does not pull at the user's hair, is low in manufacturing cost, and is suitable for mass production.

It is an object of the present invention to improve upon the bristles of known hairbrushes such as to enable the hair to be picked up or caught with greater ease and reliability, in addition to lessening a usen's possible contact with the hot areas between the bristle strips.

SUMMARY OF INVENTION

According to the present invention, this object is accomplished in that in a hairbrush of the type initially referred to a bristle section with an increased cross-sectional area adjoins the bristle base having a reduced cross-sectional area, and that between the bristle supporting structure and the section with the increased cross-sectional area the bristle is provided with a neck portion or an undercut of the section with the increased cross-sectional area. The necking provided in this arrangement is a significant taper given to the bristle cross-section relative to the section with the increased cross-sectional area. This configuration affords the advantage of enabling the hair to be better caught by the short bristles during a combing action, the undercut also causing the hair to be guided to the base surface of the bristle supporting structure with greater ease. This is particularly advantageous in hairbrushes utilized with a heatable appliance for personal use as, for example, a curling brush. The undercut on the bristles ensures an improved contact of the hair with the hot base surface, thus also producing improved hair styling results. The thickened portion of the bristles which is accomplished by the provision of a section of increased cross-sectional area further makes it less accessible or even unlikely for the user to touch the base surface of the bristle supporting structure. Moreover, the increased bristle surface also results in greater friction during combing of the hair, which has the advantage of holding the hair more firmly between the individual bristles.

In a feature of the present invention it is suggested to configure the bristles similar to the shape of a circle, a heart, a lozenge or a Rhombus, a triangle, a "T" shape or the like. The particular shape is provided in a longitudinal section parallel to the bristle longitudinal axis. This thus enables that particular bristle shape to be selected that affords the greatest advantages for the individual application. The bristles differ in particular by the extent of necking at the bristle base and the shape in the area of the bristle head.

In a further feature it is suggested to provide between the two sections of reduced and increased cross-sectional area an approximately continuous transition of the cross-sectional areas. This has the advantageous effect of preventing hair that enters the area of the neck portion from becoming wedged between the bristle and the bristle supporting structure.

This transition area between the two sections of reduced and increased cross-sectional area is approximately configured as a straight line or as an arcuate line. The advantage thereby achieved is that the bristle section with the reduced cross-sectional area merges optimally into the bristle section with the increased cross-sectional area.

In an advantageous feature it is further proposed that the variation of bristle cross-section be provided in a first plane parallel to the bristle longitudinal axis.

Drafts are provided in a second plane extending equally parallel to the bristle longitudinal axis and normal to the first longitudinal plane. Considering that bristles or bristle strips are customarily manufactured as injection-molded plastic parts, ease of manufacture is thus advantageously accomplished by enabling the bristles or a strip of bristles to be easily withdrawn from a mold.

In an embodiment of the present invention, the length of the bristles from the bristle base to the bristle head corresponds substantially to the maximum width of the bristle in the section with the increased cross-sectional area. This provides an advantageous configuration also with short bristles, enabling the hair to be picked up and held in an improved fashion.

In a particularly advantageous feature of the present invention which may also represent an independent invention, it is proposed that the bristle section with the increased cross-sectional area be adjoined by at least one second section each of a reduced and an increased cross-sectional area. With a bristle configured in this manner, the processes of catching and holding of in particular short hair are improved as compared with short bristles.

A particular embodiment of the present invention proposes that the second sections be provided in the form of a pin-shaped extension of the bristle with a spherical thickened portion at the bristle head. This proposal thus involves a relatively flexible brush with a brush head, affording the advantage of ease and reliability in use.

Advantageously, the second sections in the form of a pinshaped bristle with a spherical thickened portion at the bristle head are arranged in an essentially coaxial relationship to the first sections of reduced and increased cross-sectional area. It is thereby possible to manufacture the bristles with greater ease and accordingly economy.

Advantageously, the above-mentioned bristles may be provided in a hairbrush, in particular for employment in an appliance for personal use as, for example, a curling iron, a curling brush, a hair dryer or the like, which may also represent an independent invention.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summarization in the claims and their back-references.

DETAILED DESCRIPTION OF PREFERRED EMBODIMENTS

Figure 1:
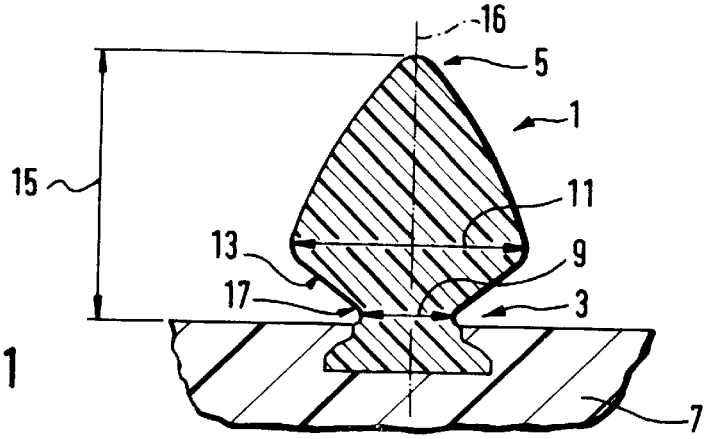
FIG. 1 is a sectional view, on a greatly enlarged scale, of a bristle of the present invention in the form of a lozenge or rhombus.

A bristle of the present invention (FIG. 1) includes a bristle base 3 and a bristle head 5, with the possibility existing for the lower part of the bristle base 3 to be configured as a bristle strip inserted into a recess of a bristle supporting structure 7 or a brush. It will be understood, of course, that a bristle may also be integrally formed with a bristle strip inserted into a hairbrush preferably parallel to the brush longitudinal axis. In longitudinal section, the bristle 1 has the shape similar to that of a lozenge or rhombus with a section with the smallest cross-sectional area 9 being provided at the bristle base 3 above the bristle supporting structure 7. The section with the largest cross-sectional area 11 is provided above the bristle base 3, a transition area 13 separating it from the smallest cross-sectional area 9. This produces a neck portion 17 between the section with the largest cross-sectional area 11 and the surface of the bristle supporting structure 7. Owing to the inclination of the transition area 13 relative to the surface of the bristle supporting structure 7, the brushing action causes the hair trapped by the neck portion 17 to be guided onto the-usually hot-surface of the bristle supporting structure 7. This results in an improved and direct contact of the hair to be treated with the hot surface of the bristle supporting structure 7. Bristle 1 has length 15 in the direction of bristle longitudinal axis 16.

Figure 2:
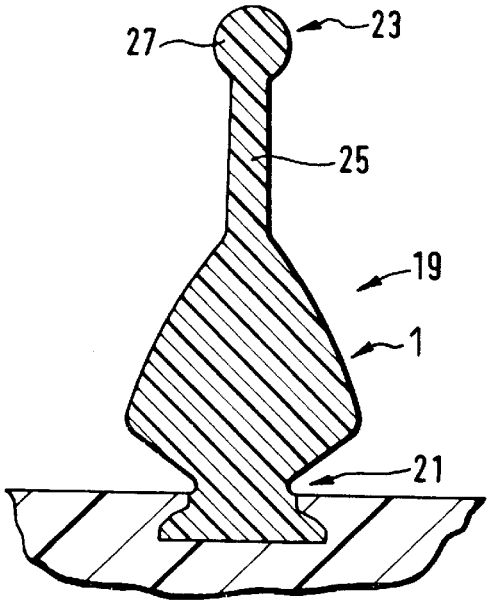
FIG. 2 is a sectional view of a bristle of FIG. 1, but including a pin-type extension and a spherical bristle head.
Figure 3:
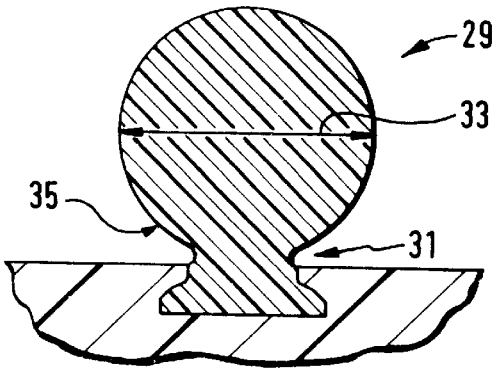
FIG. 3 is a sectional view, on a greatly enlarged scale, of a bristle in the form of a circle.

A bristle 19 (FIG. 2) comprises a bristle base 21 to which adjoins a lower bristle portion corresponding to the bristle 1 and an upper bristle portion, with the upper end of the lower bristle portion continuing in a pin-shaped extension 25 having at its upper end a spherical thickened portion 27 representing the bristle head 23. bristle 29 (FIG. 3) shows an alternative to the embodiment of FIG. 1. Adjoining the bristle base 31 is a circular bristle with a maximum cross-sectional area 33. In this embodiment, the transition area 35 between the bristle base 31 and the maximum cross-sectional area 33 is of an arcuate configuration.

Figure 4:
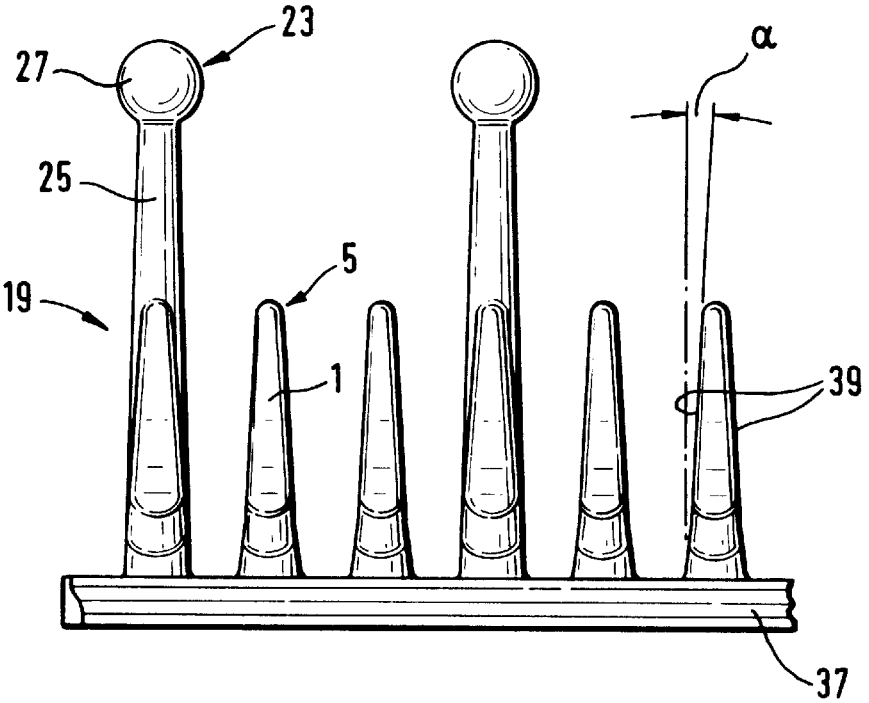
FIG. 4 is a fragmentary side view of a bristle strip showing the bristles of the present invention.

Mounted on a bristle strip 37 (FIG. 4) are differently shaped bristles 1 and 19. Bristle 1 with its bristle head 5 corresponds to the representation of FIG. 1. Bristle 19 with its bristle head 23 corresponds to the representation of FIG. 2. Bristle 19 extends beyond bristle 1 by the combined lengths of the pin 25 and the sphere 27. In FIG. 4, between each two long bristles 19 there are arranged two short bristles 1. It will be understood that any other combination of bristles 1 and 19 is equally possible. The bristles 1 and the lower part of the integrally formed bristles 19 are provided with a draft 39 identified by an angle $\alpha$ relative to a vertical, relative to the surface of the bristle strip 37. This draft 39 aids in the withdrawal of a bristle strip made, for example, as an injectionmolded plastic part, from a mold.

Figure 5:
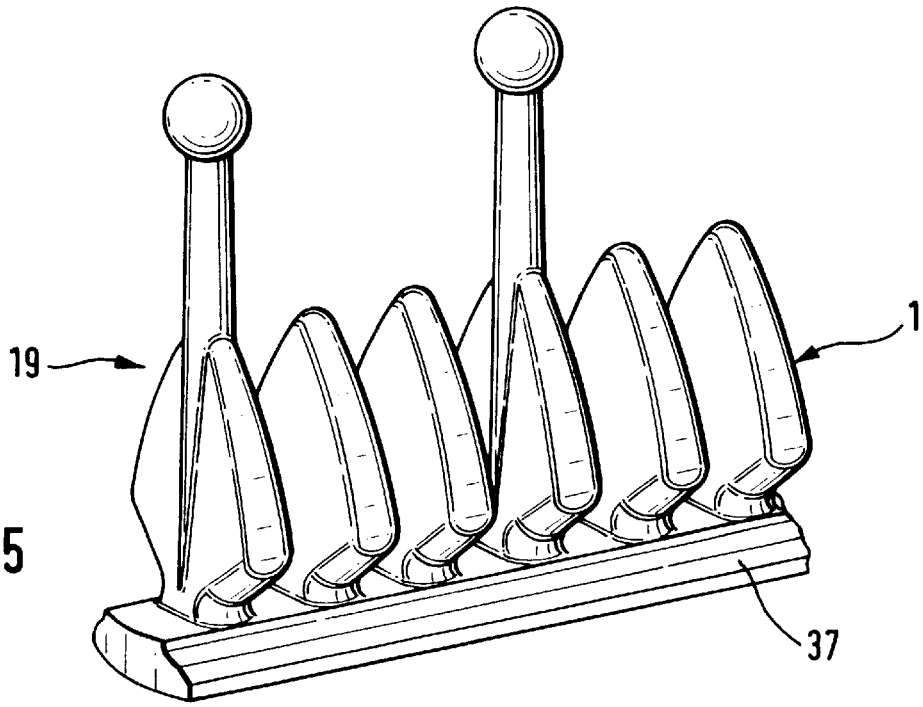
FIG. 5 is a fragmentary perspective view of a bristle strip of FIG. 4.

The bristle strip 37 with its differently shaped bristles 1 and 19 is shown in FIG. 5 in a perspective view. In this illustration, the integral construction of the bristle strips with the individual bristles 1 and 19 as well as the shape of the individual bristles closed all-round may be recognized. In a hairbrush, such bristle strips are conventionally arranged in a parallel side-by-side relationship to each other. The surface of the hairbrush may be configured in a flat or arched fashion, or also as a circumferential surface of a cylinder.

We claim:

1. Bristles for a hair treatment implement having a bristle supporting structure, said bristles comprising a bristle base head and a bristle body disposed along a longitudinal axis extending therebetween, wherein the bristle base is adapted to be mounted proximal to the bristle supporting structure, the bristle head is located in an outward direction from the bristle base, the bristle body comprises at least a first body portion having a first cross-sectional area and a second body portion having a second cross-sectional area, said second cross-sectional area being larger than said first cross-sectional area, and wherein the second body portion is adjacent the first body portion and the first body portion is proximal the bristle base, and wherein the bristle body further comprises a notch undercutting the bristle body immediately adjacent the bristle body first portion to resiliently engage hairs passing through the neck portion for applying a light pulling force to the hairs and guiding the hairs towards the base.

2. Bristles as claimed in claim 1 wherein the bristle body has in longitudinal section a shape selected from a group of shapes consisting of a circle, a heart, a lozenge, a rhombus, a triangle, and a T-shape.

3. Bristles as claimed in claim 1 wherein the bristle body further comprises a transition portion blending the adjacent first and second body portions.

4. Bristles as claimed in claim 3 wherein the transition portion is selected from a group segments consisting of a linear taper segment and a curvilinear segment.

5. Bristles as claimed in claim 1 wherein the bristle body further comprises a transition portion between the first and second body portions in a first longitudinal plane parallel to the bristle longitudinal axis.

6. Bristles as claimed in claim 1 wherein a length of the bristles along the bristle longitudinal axis is about equal to a widest width of the bristle body.

7. Bristles as claimed in claim 1 wherein the bristle body of at least a portion of the bristles further comprises an extension adjoining the second body portion in an outward direction, said extension further comprising first and second extension portions, said first and second extension portions having cross-sectional areas dissimilar to one another.

8. Bristles as claimed in claim 7 wherein the first extension portion further comprises a pin adjoining the second body portion and the second extension portion further comprises a spherical portion.

9. Bristles as claimed in claim 7, wherein the extension is essentially coaxial with the bristle body.

10. Bristles as claimed in claim 1 in combination with the hair treatment implement, said implement being selected from a group of implements consisting of a hairbrush, a curling iron, a curling brush, and a hair dryer.

11. Bristles as claimed in claim 1 wherein the bristles are integrally formed in a bristle strip.

12. Bristles as claimed in claim 1, wherein a ratio of the second body portion cross-sectional area to the first body portion cross-sectional area is at least about 2:1.

13. Bristles as claimed in claim 1, wherein the second body portion has a widest portion transverse to the longitudinal axis located, in the direction of the longitudinal axis, above a juncture of the first body portion and the base a distance of less than about twice a mean width of the first body portion, said mean width being transverse to the longitudinal axis.

14. Bristles as claimed in claim 13, herein the distance is less than about the mean width of the first body portion.

15. Bristles for a hair treatment implement having a bristle supporting structure, said bristles comprising a bristle base, a bristle head and a bristle body disposed along a longitudinal axis extending therebetween, wherein the bristle base is adapted to be mounted proximal to the bristle supporting structure, the bristle head is located in an outward direction from the bristle base and the bristle body comprises drafts extending in a plane inclined with respect to the bristle longitudinal axis, the bristle body further comprises at least a first body portion having a cross-sectional area and a second body portion having a second cross-sectional area, said second cross-sectional area being larger than said first cross-sectional area, and wherein the second body portion is adjacent the first body portion and the first body portion is proximal the bristle base, and wherein the bristle body further comprises a transition flank surface continuously narrowing from the second body portion towards the first body portion, said transition flank surface intersecting the first body portion immediately adjacent the bristle body first portion between the bristle base and the second body portion to resiliently engage hairs passing through the neck portion for applying a light pulling force to the hairs and guiding the hairs towards the base.

16. An implement for styling hair of a user, said implement comprising a hair treatment surface comprising a bristle supporting structure and a plurality of bristles, said bristles comprising a basal portion adapted to be mounted proximal the bristle supporting structure, a tip portion located in an outward direction from the basal portion, and a body portion disposed along a first axis extending between the basal and tip portions, wherein the body portion further has a narrow portion having a first width and a wide portion having a second width greater than the first width and a transition flank joining said wide and narrow portions, wherein an angle subtended between a tangent to the transition flank and the bristle supporting structure forms a notch undercutting the body portion proximal the supporting structure to releasably engage hair passing through the notch.

17. An implement as claimed in claim 16 wherein the body portion has at a location along the first axis outward from the basal portion a width dimension along a second axis lying in a plane parallel to a longitudinal section through the body, said second axis being perpendicular to the first axis, and wherein the body further has at the location along the first axis a thickness dimension along a third axis perpendicular to each of the first and second axis, said width dimension being greater than said thickness dimension.

18. An implement as claimed in claim 16 wherein the body portion comprises in longitudinal section a shape selected from a group of shapes consisting of a circle, a heart, a lozenge, a rhombus, a triangle and a T-shape.

19. An implement as claimed in claim 16 wherein the body portion comprises in longitudinal section two opposed said notches.

20. An implement as claimed in claim 16 wherein the angle is less than about 40°.

21. An implement for styling hair of a user, said implement comprising a hair treatment surface comprising a plurality of hair pickup elements and a hair pickup element supporting structure, said hair pickup elements comprising a stem portion adapted to be mounted adjacent the supporting structure, a head portion located in an outward direction from the stem portion, and a blade-shaped body comprising an elongated broad flattened body portion depending from the head portion inward towards the stem portion along a first axis between the head and stem portions, whereby said stem portion spaces the body portion from the supporting structure to define a notch undercutting the body portion and the hair treatment surface for releasably engaging hair in the notch and guiding it towards the hair treatment surface as the pickup elements catch hair of the user.

22. An implement as claimed in claim 21 wherein the body portion comprises in longitudinal section a shape selected from a group of shapes consisting of a circle, a heart, a lozenge, a rhombus, a triangle and a T-shape.

23. An implement as claimed in claim 21 wherein the body portion comprises in longitudinal section two opposed said notches.

24. An implement as claimed in claim 21 wherein said implement is selected from a group of implements consisting of a hairbrush, a curling iron, a curling brush, and a hair dryer.

25. An implement as claimed in claim 21 wherein the widest portion of the body portion is spaced a distance less than twice the stem portion mean width away from the hair treatment surface.

* * * * *

UNITED STATES PATENT AND TRADEMARK OFFICE

CERTIFICATE OF CORRECTION

PATENT NO. : 5,771,904

DATED : June 30, 1998

INVENTOR(S) : Peter Lange, et al

It is certified that error appears in the above-identified patent and that said Letters Patent is hereby corrected as shown below:

In Claim 1, at col. 4, line 31 insert after "bristle base" --,a bristle--;

at column 4, line 46 change "neck portion" to --notch--;

in Claim 14, at col. 5, line 27 change "herein" to --wherein--;

in Claim 15, at col. 5, line 40, insert --first-- before "cross-sectional"; and at col. 5, line 50 after "immediately adjacent" insert --the bristle base, whereby the transition flank forms a neck portion immediately adjacent--.

Signed and Sealed this

Third Day of November, 1998

*Attest:*

Bruce Lehman

BRUCE LEHMAN

*Attesting Officer*

*Commissioner of Patents and Trademarks*